United States Patent [19]

Dexheimer

[11] Patent Number: 4,702,741

[45] Date of Patent: Oct. 27, 1987

[54] POLYOXYALKYLENE SPIN FINISH LUBRICANTS HAVING LOW COEFFICIENTS OF FRICTION

[75] Inventor: Edward M. Dexheimer, Grosse Ile, Mich.

[73] Assignee: BASF Corporation, Parsippany, N.J.

[21] Appl. No.: 715,346

[22] Filed: Mar. 25, 1985

[51] Int. Cl.[4] ..... D06M 15/00

[52] U.S. Cl. ..... 8/115.6; 252/8.8; 252/8.9

[58] Field of Search ..... 8/115.6; 252/8.8, 8.9

[56] References Cited

U.S. PATENT DOCUMENTS

| | | | |
|---|---|---|---|
| 3,657,386 | 4/1972 | Weedon et al. | 525/430 |
| 4,024,205 | 5/1977 | Login | 260/857 PG |
| 4,098,842 | 7/1978 | Login | 260/857 PG |

*Primary Examiner*—Paul Lieberman
*Assistant Examiner*—John F. McNally
*Attorney, Agent, or Firm*—William G. Conger

[57] ABSTRACT

Fiber spin finish lubricants are disclosed which are ethylenediamine initiated "reverse" polyoxypropylene-polyoxyethylene block copolymers. These fiber lubricants possess exceptionally low coefficients of friction, comparable with butyl stearate and, in addition, possess water solubility, antistatic characteristics, and thermal stability

20 Claims, No Drawings

POLYOXYALKYLENE SPIN FINISH LUBRICANTS HAVING LOW COEFFICIENTS OF FRICTION

BACKGROUND OF THE INVENTION

1. Field of the Invention

The subject invention relates to fiber spin finishes containing fiber lubricants which produce both exceptional lubricity and low residue levels. More particularly, the invention relates to the use of polyoxyalkylene polyethers, prepared by oxyethylating and then oxypropylating ethylenediamine or N,N,N',N'-tetrakis[2-hydroxyalkyl]ethylenediamines, as spin finish lubricants.

2. Description of the Related Art

Fiber finishing compositions are a necessary part of modern, high speed synthetic fiber manufacture. Virtually all operations performed on the fibers following their being spun from the melt require the presence of suitable fiber finishes to prevent snarling and breaking, thus enabling high fiber throughput. Generally speaking, a quality fiber finish must provide several, often conflicting qualities. For example, the fiber finish must qualify both the interaction between the fiber and the machinery on which it is processed, and also the interactions among the fiber filaments themselves. This property is usually termed "lubricity" although in reality the change in the interactions caused by the fiber lubricant may occasionally result in a desirable increase in friction as well as the decrease in friction ordinarily associated with the term "lubricant."

Generally, however, it is desirable for the fiber finish to have high "lubricity," corresponding to a low coefficient of friction. Experimentally, coefficients of friction are measured by applying a solution of the lubricant to a fiber and measuring the coefficient of friction as the fiber is drawn across a satin finished metal spool or pin. One such device in common use for this purpose is the Rothschild "F-meter."

Mineral oil and butyl stearate are commonly used as fiber lubricants because of their excellent lubricity. Unfortunately they have a number of critical disadvantages, making their replacement progressively more important as production technology improves. Among the disadvantages are poor thermal stability and virtually complete insolubility in water. The lack of thermal stability causes a serious air pollution problem as the volatile spin finish boils off the fiber during fiber finishing operations. The lack of water solubility necessitates the addition of emulsifiers, since the lubricants are applied at concentrations of approximately 10 percent by weight in water. The addition of commonly used emulsifiers such as oxyethylated nonyl phenols to the formulation, however, not only increases the complexity of the fiber finish, but due to the relatively high coefficient of friction of the emulsifier itself, the fiber finish emulsion does not retain the advantage of the low coefficient of friction associated with butyl stearate or mineral oil alone.

The use of polyoxyalkylene polyethers themselves as the fiber lubricant component has been proposed as a means of avoiding the necessity of emulsifying a hydrophobic oil. Polyethers containing appreciable amounts of oxyethylene residues, for example, are generally completely water soluble at the concentrations used in fiber finishes. Unfortunately, along with the benefits accorded by water solubility come some disadvantages.

Chief among these disadvantages is the much higher coefficient of friction possessed by even the best prior art polyoxyalkylene polyether lubricants, especially those with high oxyethylene group content. The coefficients of friction of many commercial fiber lubricants have been measured using the Rothschild F-meter. Commerical fiber lubricants such as PLURONIC® polyether polyols and ethylenediamine initiated polyoxypropylene-polyoxyethylene block copolymer polyether polyols which are representative of modern polyether fiber lubricants, have coefficients of friction of from ca. 0.49 to 0.60, averaging approximately 0.55, relative to the 0.35 coefficient of friction of butyl stearate.

A further disadvantage of the nonionic polyether lubricants, one which is shared with lubricants such as mineral oil and butyl stearate, is the necessity to add antistats to the finish composition. The fiber finish composition must be able to control static electricity generated during fiber processing. Generally, ionic organic compounds such as synthetic phosphate and sulfonate detergents are useful as antistats and are added to the fiber finish composition for this purpose. As in the case of the emulsifiers discussed previously, these added antistats do not themselves possess low coefficients of friction. Therefore, their presence, while necessary to control static electricity, causes undesirable changes in the lubricity of the finish.

The fiber finishes are generally applied in the form of an aqueous emulsion by any one of several methods including the use of kiss rolls, sprayers, baths and squeeze rollers, and grooved ceramic guides and metering pumps. To maintain a stable emulsion of the lubricant and antistat components, deleterious surfactants such as fatty alcohol oxyethylates and nonylphenol oxyethylates, as indicated previously, are generally necessary.

A suitable fiber finish must also be easily removable from the fiber or yarn so as not to interfere with subsequent operations such as dyeing and bleaching. Furthermore, since the finish performs its intended functions only on the outside of the fiber, it should not be easily absorbed into the fiber proper. Penetration of the fiber lubricant into the fiber increases the quantity of lubricant required during the finishing operation and, in addition, may cause undesirable changes in the physical properties of the fibers themselves.

As the fiber throughput associated with modern fiber finishing operations has increased, the demands placed upon the fiber finish, especially the lubricant which comprises a major portion of the finish, have increased as well. In drawing and twisting operations, for example, the fiber is drawn across a heater plate, hot draw roll or heated pin in order to raise the temperature of the fiber to the plastic deformation stage. The fibers then undergo stretching, twisting, tangling, or a combination of these operations. The cooled, stretched fiber generally has a much higher tensile strength than the raw fiber. If the fiber has been twisted or tangled in addition to being stretched, it retains these modifications, thus imparting improved feel, fabric cover, recovery from deformation and other properties felt desirable by the textile industry. The fibers may also be textured by processes such as stuffer-tube crimping and edge crimping. These processes also require the fibers to be heated to the same relatively high temperatures as for drawing and twisting, generally in the neighborhood of 190° C. or higher.

As the fiber throughput increases, the temperature of the heating elements must be increased as well in order for the faster moving fibers to be heated to the requisite processing temperatures. Fiber processing machinery is capable of running at speeds in excess of 1000 m/min. At these high speeds, however, the primary heater plate temperature must be maintained at temperatures of 250° C. or higher to enable sufficient heat transfer to the fast moving fibers. At these high temperatures, many prior art lubricants such as butyl stearate and mineral oil volatilize to such an extent so as to leave the fiber with virtually no lubricant coating while at the same time causing a serious fuming problem. Others, particularly the vegetable oils, do not show this high degree of volatility and thus do not leave the fibers totally baren of lubricant at high heater plate temperatures, but instead tend to resinify, causing a rough resinous coating to cover the heater plate. This buildup of resinous coating on the heater plate not only causes decreased thermal transfer from the plate to the fiber but, more importantly, is a primary cause of broken filaments. The need for a fiber lubricant having high lubricity which will neither volatilize too rapidly nor build up resinous deposits at high temperatures has heretofore limited operating speeds to 700 to 800 m/min. In addition to causing broken filaments, the resinous heater plate deposits may adhere to the fibers, causing additional problems such as uneven dyeing in subsequent operations owing to the greater difficulty in removing the resinous by-products as opposed to the unaltered lubricants themselves.

Due to the loss of production time necessitated by cleaning operations or, in some cases equipment replacement, caused by buildup of fiber finish residue, low residue is important even for lower speed operations, or operations with heavy denier fibers. Although the buildup of residue is much slower under the lower temperature conditions of slower fiber finishing, eventually a residue level is reached which requires cleaning and replacement operations to be performed. Thus fiber lubricants which yield low residue are important for both low as well as high speed fiber processing.

SUMMARY OF THE INVENTION

An ideal fiber lubricant should possess all the qualities previously discussed. Such lubricant would be water soluble, have a low coefficient of friction, preferably of the same magnitude or lower than butyl stearate, possess antistatic properties without the need to add separate antistats, have a low initial volatility, yet be thermally stable so as to leave little residue on process machinery, and be easily removable from the fiber.

It was surprisingly found that a limited class of "reverse" polyoxyethylene-polyoxypropylene copolymer polyethers based on ethylenediamine or N,N,N′,N′-tetrakis[2-hydroxyalkyl]ethylenediamine initiators possess exceptional lubricity as compared to other polyether lubricants. This class of polyethers was disclosed for use as nonionic surfactants in U.S. Pat. No. 3,036,118. However, the utilization of these polyether polyols as fiber lubricants has only now been discovered.

The "reverse" polyoxyalkylene polyethers of the subject invention possess several highly desirable characteristics such as water solubility, rinseability, low residue on fiber processing equipment such as heater plates, and limited antistatic properties. Most importantly, however, they possess coefficients of friction which are comparable to the industry standard, butyl stearate. This is particularly surprising in view of the fact that the "normal" polyoxypropylene-polyoxyethylene copolymers based on ethylenediamine or N,N,N′N′-tetrakis[2-hydroxylalkyl]ethylenediamines do not possess these low coefficients of friction. Furthermore, even other members of the same general class of "reverse" ethylenediamine initiated block copolymer polyether polyols fail to exhibit the high lubricity of the polyethers of the subject invention.

It is therefore an object of the subject invention to provide a superior fiber finish, and therefore to enable higher fiber processing speeds, less process down-time or both, by utilizing an economical, highly lubricious low-residue lubricant additive in the fiber finish. This objective was unexpectedly met by the use of certain fiber lubricants which are a cogeneric mixture of polyoxyalkylene polyols prepared by the sequential oxyethylation and oxypropylation of ethylenediamine or N,N,N′,N′-tetrakis[2-hydroxyalkyl]ethylenediamines. These polyether lubricants must have molecular weights from about 10,000 to 30,000 Daltons, and polyoxyethylene blocks which comprise from 60 to 95 percent of the total polymer weight.

DESCRIPTION OF THE PREFERRED EMBODIMENTS

The fiber lubricants of the subject invention are certain polyoxyethylene-polyoxypropylene block copolymer polyethers containing external polyoxypropylene hydrophobes and an internal polyoxyethylene hydrophile. These copolymer polyethers are prepared by sequentially oxyethylating and oxypropylating ethylenediamine, or a low molecular weight initiator based on ethylenediamine. Suitable initiators, for example, are ethylenediamine, N,N,N′,N′-tetrakis[2-hydroxyethyl]ethylenediamine, N,N,N′,N′-tetrakis[2-hydroxypropyl]ethylenediamine and N,N,N′,N′-tetrakis[2-hydroxybutyl]ethylenediamine. Preferred are ethylenediamine and N,N,N′,N′-tetrakis[2-hydroxypropyl]ethylenediamine. The latter is especially preferred as it has relatively low toxicity and volatility and, in addition, is readily commercially available as QUADROL® polyol.

The preparation of polyoxyalkylene polyether polyols by the oxyalkylation of initiators such as ethylenediamine and the various N,N,N′,N′-tetrakis[2-hydroxyalkyl]ethylenediamines is well known to those skilled in the art. Preparation of these polyethers for use as nonionic surfactants in detergent formulations, for example, is disclosed in U.S. Pat. No. 3,036,118 which is hereby incorporated by reference.

Preparation of the lubricants of the subject invention is accomplished by the successive ring-opening condensation polymerization of oxirane and methyloxirane onto the initiator in the presence of either a basic catalyst or a Lewis acid catalyst. Basic catalysts are preferred. Suitable basic catalysts are alkali metal and alkaline earth metal hydroxides such as lithium hydroxide, sodium hydroxide, potassium hydroxide, calcium hydroxide, and barium hydroxide. Preferably used are sodium hydroxide and potassium hydroxide. Alkali metal alkoxides such as sodium methoxide and potassium methoxide are also suitable. Generally, the amount of catalyst required is from 0.01 percent to 10 percent by weight of the initiator charge.

The oxyalkylation is performed by addition of oxirane, followed by the addition of methyloxirane. From 100 to 650 moles of oxirane per mole of initiator are added in one or more steps to form the polyoxyethylene hydrophile, following which from 80 to 210 moles of methyloxirane per mole of initiator are added. The relative and total amounts of oxirane and methyloxirane are adjusted in such a manner that the average molecular weight of the polyether lubricants is from approximately 10,000 to approximately 30,000 Daltons. Preferably, the polyether lubricants have molecular weights of between 12,000 and 20,000 Daltons, most preferably between 13,000 and 19,000 Daltons. The amount of oxyethylene moieties, expressed as percent by weight relative to the average total molecular weight, is between 60 and 95 percent. Preferably, however, the percent of the oxyethylene groups is from 65 to 90 percent, and most preferably, from 65 to 80 percent by weight.

The polyether lubricants of the subject invention possess a combination of properties which is unique in commercial fiber finishes. They possess lubricity characteristics which are at least comparable to butyl stearate; they are water soluble to the extent required in fiber finishing operations so as to require no additional emulsifier; they possess a modicum of antistatic characteristics by virtue of their two tertiary amine groups; they are easily removed from the fiber by water washing; and they result in only small amounts of residue in fiber finishing operations.

While the polyoxyalkylene polyether lubricants of the subject invention may be used as the sole component in some fiber finishing operations, it may be preferable to combine these fiber lubricants with suitable auxiliaries and additives in the formulation of fiber finishes for particular applications. For high speed finishing, for example, it may be desirable to add more powerful antistats to augment the modest antistatic character of the polyether lubricant. Biocides such as microbiocides and fungicides may be added to ensure long term storage.

The polyoxyalkylene polyether lubricants of the subject invention may also be utilized in conjunction with other fiber lubricants such as butyl stearate and mineral oil. In this case, the lubricants of the subject invention are especially useful as their surface active characteristics may be used to advantage in assisting the emulsification of the butyl stearate and/or mineral oil lubricants without compromising the low coefficients of friction which these auxiliary lubricants provide. Furthermore, the lower high temperature volatility of the subject invention polyether lubricants complements the higher initial volatility of the auxiliary lubricants. Thus, as the auxiliary lubricants volatilize at higher temperatures, the fiber will still retain a lubricant coating due to the subject polyether lubricant.

The following examples are intended to illustrate the subject matter of the invention, but are not intended to limit it in any particular. Unless otherwise specified, all percentages are by weight. In these examples, a multistep procedure was utilized for convenience in manufacturing. In the first step, a base polyether polyol was formed in two steps by oxyalkylating N,N,N',N'-tetrakis[2-hydroxypropyl]ethylenediamine (QUADROL® polyol). This base polyether was then utilized to form the polyethers of the subject invention by successive oxyethylation and oxypropylation.

Base Polyether Preparation

To a clean, nitrogen flushed stainless steel autoclave was added 1000 grams QUADROL® polyol (N,N,N',N'tetrakis[2-hydroxypropyl]ethylenediamine), and 100 grams of 45 percent aqueous KOH. After purging and pressure checking, the reactor was heated to 100° C. following which water was stripped off at 10 torr and 140° C. The vacuum was relieved with dry nitrogen and the reactor pressurized to 34 psig. Oxirane in an amount of 1370 grams was added incrementally. Following addition of the oxirane, the reactor was maintained at 140° C. for one hour following which the reactor was allowed to cool, the pressure relieved, and the product discharged. Of this product, 625 grams was transferred to another autoclave, an additional 62.5 grams 45 percent aqueous KOH added, the reactor purged and pressure checked as before, and water again stripped off at 10 torr and 140° C. Following pressurization with nitrogen to 34 psig, 1875 grams of oxirane was added incrementally at a pressure less than 90 psig. Following completion of the oxirane addition, residual unreacted oxirane was allowed to react out over a period of one hour, the reactor cooled to 60° C., vented, and discharged. The product base polyether had a hydroxyl number of 80, corresponding to a number average molecular weight of 2805 Daltons.

Fiber Lubricant 1

A 12,000 number average molecular weight polyether lubricant having a 75 percent oxyethylene group content was prepared. To a one-gallon stainless steel autoclave was added 429 grams of previously prepared base polyether and 11.5 grams of 45 percent KOH. The reactor was sealed, purged with nitrogen, and pressure checked. It was then heated to 135° C. while evacuating to 10 torr. Water was stripped off at 10 torr, following which the pressure was adjusted to from 0 to 2 psig with nitrogen and heating continued until a temperature of 140° C. was attained. The reactor was pressurized to 34 psig with nitrogen and 1570 grams of oxirane was added incrementally at less than 90 psig. Following completion of the oxirane addition, the reactor was held at 140° C. for one to two hours until constant pressure was achieved. It was then cooled to 115° C. and vented to 0 psig. Methyloxirane in an amount of 604 grams was then added at a rate of 200 grams/hour at less than 90 psig. Following completion of the methyloxirane addition, the temperature was maintained at 115° C. for from 3.5 to 4.5 hours until constant pressure was attained. The reactor was vented and the product discharged. The polyether lubricant was neutralized with acetic acid. The hydroxyl number was determined to be 19.5.

Fiber Lubricant 2

Utilizing the same base polyether as used in the preparation of fiber lubricant 1 and the same experimental technique, a polyether lubricant having a number average molecular weight of approximately 13,700 and an oxyethylene group content of 68 percent by weight was prepared. The product had a hydroxyl number of 16.4.

Fiber Lubricant 3

Utilizing the same base polyether as used in the preparation of fiber lubricant 1 and the same experimental technique, a polyether lubricant having a number average molecular weight of approximately 18,700 and an oxyethylene group content of 85 percent by weight was prepared. The product had a hydroxyl number of 12.

Comparative Fiber Lubricant 4

The procedure, similar to that used to prepare fiber lubricant 3, was followed but the order of addition of oxirane and methyl oxirane was reversed, resulting in a polyether with internal as opposed to external hydrophobes.

Comparative Fiber Lubricant 5

The procedure used to prepare fiber lubricant 1 was followed, but the amounts of oxirane and methyl oxirane adjusted to prepare a polyether having a number average molecular weight of 3450 and a polyoxyethylene block comprising 20 percent by weight of the polymer. The finished polyether product had a hydroxyl number of 65.5.

Comparative Fiber Lubricant 6

The procedure utilized to prepare fiber lubricant 1 was followed, but the amounts of oxirane and methyloxirane adjusted to prepare a polyether having a number average molecular weight of 10,200 and a polyoxyethylene block comprising 46 percent by weight of the polymer. The finished polyether product had a hydroxyl number of 22.4.

Measurement of Coefficient of Friction

The equipment used for this test included a Leesona 861 winder, Sage model 352 syringe pump, and a Rothschild R1083 friction meter. The fiber used in the tests was 150 denier/34 filament fully drawn finish-free polyester supplied by the Celanese Corporation. Fiber lubricants were applied as 10 percent solutions, using water where possible as the solvent, otherwise isopropyl alcohol was used. Hexane was used for butyl stearate. The winder wa operated at 100 m/min; the syringe pump was adjusted to apply finish at a rate corresponding to 1.0 percent neat lubricant, based on the weight of the fiber.

Ten grams of fiber was wound onto a plastic cone, dried in an oven at 80° C. and weighed exactly. The cone was unwound through the winder, applying 1 percent finish. The cones were then placed in a room maintained at 65 percent relative humidity and 70° F. After standing overnight, the coefficient of friction was measured on the friction meter in the constant temperature and humidity room. The friction meter was operated at 100 m/min, using a chrome plated pin with a satin finish and a 170° wrap angle. Yarn tension was maintained by 10g pretension. After the friction measurement, the fiber was dried again in an 80° C. oven and the exact add-on of lubricant calculated.

All coefficient of friction measurements were "normalized" to a butyl stearate value of 0.35. Measurements were made on six lubricants at a time. For those sets of measurements in which butyl stearate was not exactly 0.35, a scaling factor was used to normalize the measurements:

$$\frac{\text{value of butyl stearate}}{0.35} = \frac{\text{normalized coefficient}}{\text{measured coefficient of lubricant}}$$

The coefficients of friction of fiber lubricants 1–3, comparative fiber lubricants 4–6, and several commercial lubricants were measured. The results are presented in Table I below.

TABLE I

| Fiber Lubricant | Representative Measured Coefficients of Friction | Average |
|---|---|---|
| Butyl Stearate | 0.35 | 0.35 |
| 1 | 0.48, 0.46 | 0.47 |
| 2 | 0.35, 0.33, 0.40, 0.37, 0.44 | 0.38 |
| 3 | 0.37, 0.43, 0.40 | 0.40 |
| 4 (comparative) | 0.51 | 0.51 |
| 5 (comparative) | 0.64, 0.59 | 0.62 |
| 6 (comparative) | 0.53, 0.56 | 0.54 |
| PLURONIC ® L-35 | 0.49, 0.50, 0.51 | 0.50 |
| PLURONIC ® 10R5 | 0.50, 0.50, 0.52 | 0.51 |

Fiber Lubricant Residue

Pan tests were conducted by adding a measured amount of fiber lubricant to a tared, open pan and placing the pan in a circulating air oven maiantained at 210° C. for periods of up to 24 hours. The residue at various times is expressed as percent residue relative to the orginal weight of lubricant. Table III shows that the fiber lubricants of the subject invention do not have high volatility as does butyl stearate, nor do they leave large amounts of resinous residue.

TABLE III

| Fiber Lubricant | Residue, % by weight | |
|---|---|---|
| | After 1 hour | After 24 hours |
| Butyl Stearate | — | negligible |
| 2 | 62.2 | 6.4 |
| 3 | 65.8 | 9.3 |
| PLURONIC ® L-35 | 2.7 | 0.4 |
| Coconut Oil | —* | 58.4 (resinifies) |
| TWEEN ® 60 | —* | 39.3 (resinifies) |

*not measured

The embodiments of the invention in which an exclusive privilege or property is claimed are defined as follows:

1. In a process for high-speed synthetic fiber finishing wherein a fiber finishing composition containing one or more fiber lubricants, emulsifiers, antistats, and other fiber processing auxiliaries is coated onto the fiber, the improvement comprising employing as a fiber lubricant a block copolymer polyether prepared by first oxyethylating an initiator selected from the group consisting of ethylenediamine, N,N,N',N'-tetrakis[2-hydroxyethyl]ethylenediamine, N,N,N'N'-tetrakis[2-hydroxypropyl]ethylenediamine, and N,N,N'N'-tetrakis[2-hydroxybutyl]ethylenediamine, and subsequently oxypropylating the oxyethylated initiator, wherein said polyether has a molecular weight of from about 10,000 to about 30,000 Daltons, and a polyoxyethylene hydrophile content of from about 60 percent to 95 percent by weight of the polyether.

2. The process of claim 1 wherein said polyether has a molecular weight of from 12,000 to about 20,000 Daltons and a polyoxyethylene hydrophile which comprises from about 65 to 80 percent by weight of the polyether.

3. The process of claim 1 wherein said initiator is ethylenediamine.

4. The process of claim 1 wherein said initiator is N,N,N'N'-tetrakis[2-hydroxypropyl]ethylenediamine.

5. The process of claim 1 wherein said polyoxyethylene hydrophile comprises about 70 percent by weight of the polyether.

6. The process of claim 2 wherein said initiator is ethylenediamine.

7. The process of claim 2 wherein said initiator is N,N,N'N'-tetrakis[2-hydroxypropyl]ethylenediamine.

8. In a fiber finish composition suitable for use with synthetic fibers and containing one or more fiber lubricants, emulsifiers, antistats, and other fiber processing auxiliaries, the improvement comprising including at least one polyether fiber lubricant which is a block copolymer polyether containing an internal polyoxyethylene hydrophile and an external polyoxypropylene hydrophobe prepared by sequentially oxyethylating and oxypropylating an initiator selected from the group consisting of ethylenediamine, N,N,N',N'-tetrakis[2-hydroxyethyl]ethylenediamine, N,N,N'N'-tetrakis[2-hydroxypropyl]ethylenediamine, and N,N,'N'-tetrakis[2-hydroxybutyl]ethylenediamine, wherein said polyether has a molecular weight of from about 10,000 to about 30,000 Daltons, and wherein said polyoxyethylene hydrophile comprises from about 60 percent to 95 percent by weight of the polyether.

9. The composition of claim 8 wherein said polyether has a molecular weight of from 12,000 to about 20,000 Daltons and a polyoxyethylene hydrophile which comprises from about 65 to 80 percent by weight of the polyether.

10. The composition of claim 8 wherein said initiator is ethylenediamine.

11. The composition of claim 8 wherein said initiator is N,N,N'N'-tetrakis[2-hydroxypropyl]ethylenediamine.

12. The composition of claim 8 wherein said polyoxyethylene hydrophile comprises about 70 percent by weight of the polyether.

13. The composition of claim 9 wherein said initiator is ethylenediamine.

14. The composition of claim 9 wherein said initiator is N,N,N'N'-tetrakis[2-hydroxypropyl]ethylenediamine.

15. A fiber finishing composition suitable for use with synethetic fibers and comprising at least one polyether fiber lubricant which is a block copolymer polyether containing an internal polyoxyethylene hydrophile and an external polyoxypropylene hydrophobe, prepared by first subsequently oxyethylating and oxypropylating an initiator selected from the group consisting of ethylenediamine, N,N,N',N'-tetrakis[2-hydroxyethyl]ethylenediamine, N,N,N'N'-tetrakis[2-hydroxypropyl]ethylenediamine, and N,N,N'N'-tetrakis[2-hydroxybutyl]ethylenediamine, wherein said polyether has a molecular weight of from about 10,000 to about 30,000 Daltons, and wherein said polyoxyethylene hydrophile comprises from about 60 percent to 95 percent by weight of the polyether, and a second fiber lubricant selected from the group consisting of (a) butyl stearate, (b) mineral oil, (c) vegetable oils, and (d) mixtures thereof.

16. The composition of claim 15 wherein said polyether has a molecular weight of from 12,000 to about 20,000 Daltons and a polyoxyethylene hydrophile which comprises from about 65 to 80 percent by weight of the polyether.

17. The composition of claim 15 wherein said second fiber lubricant is butyl stearate.

18. The composition of claim 16 wherein said second fiber lubricant is butyl stearate.

19. The composition of claim 15 wherein said vegetable oil is coconut oil.

20. A composition comprising a synthetic fiber coated with the composition of claim 8.

* * * * *